US005799415A

United States Patent [19]

Kenji et al.

[11] Patent Number: 5,799,415

[45] Date of Patent: Sep. 1, 1998

[54] INSOLE

[76] Inventors: Nishimura Kenji, No. 2-27, Chu Shui 3 Ting Mu, Hsiung Pen City, Hsiung Pen Conty; Nagase Isao, No. 13-2, Chu Shi 4 Ting Mu, Husiung Pen City, Huiung Pen Conty, both of Japan; Sen Po Lin, 2nd Floor, No. 35, Lane 14, Sec. 7, Chung Shan N. Rd., Taipei, Taiwan

[21] Appl. No.: 692,629

[22] Filed: Aug. 6, 1996

[51] Int. Cl.[6] ..... A43B 13/38; A43B 1/02

[52] U.S. Cl. ..... 36/44; 36/3 R; 36/9 A

[58] Field of Search ..... 36/43, 44, 3 R, 36/3 B, 9 A

[56] References Cited

U.S. PATENT DOCUMENTS

| | | | |
|---|---|---|---|
| 355,140 | 12/1886 | Cole | 36/44 |
| 1,219,890 | 3/1917 | West | 36/44 |
| 3,442,031 | 5/1969 | Antell | 36/43 |
| 5,606,807 | 3/1997 | Prepodnik | 36/9 A |

FOREIGN PATENT DOCUMENTS

| | | |
|---|---|---|
| 7-23805 | 1/1995 | Japan . |
| 7-23807 | 1/1995 | Japan . |
| 7-136004 | 5/1995 | Japan . |
| 664066 | 2/1988 | Switzerland . |

*Primary Examiner*—M. D. Patterson

[57] ABSTRACT

An insole comprising an absorptive flat paper base panel, and a corrugated paper cover panel covered on the absorptive flat base panel, the corrugated paper cover panel having a plurality of folds and furrows alternatively arranged together and defining with the absorptive flat paper base panel a plurality of ventilation spaces.

2 Claims, 2 Drawing Sheets

INSOLE

BACKGROUND OF THE INVENTION

The present invention relates to insoles for shoes, and relates more particularly to a disposable insole.

A variety of insoles have been disclosed, and have appeared on the market. Exemplars are seen in Taiwan Patent Application No. 84210996 entitled "INSOLE WITH FAR-INFRARED EFFECT", Taiwan Patent Application No. 84207737 entitled "FORCED VENTILATION TYPE INSOLE STRUCTURE", Taiwan Patent Application No. 83212978 entitled "VENTILATING INSOLE". These insoles are commonly designed to improve ventilation, to absorb sweat, to eliminate unpleasant smell, etc.

SUMMARY OF THE INVENTION

It is one object of the present invention to provide an insole which is disposable. It is another object of the present invention to provide an insole which has a renewable top. It is still another object of the present invention to provide an insole which can be conveniently adjusted to change the thickness. A disposable insole in accordance with the present invention can be made in a two-ply structure comprised of a flat base panel and a corrugated cover panel, or a multi-ply structure comprised of a flat base panel and a stack of corrugated cover panel. In a two-ply structure, the corrugated cover panel has folds and furrows alternatively arranged together, and defining with the top side of the flat base panel a plurality of ventilation spaces. In a multi-ply structure, the corrugated cover panels have folds and furrows, and a respective tongue at the front end. Through the tongue, the top corrugated cover panel can be detached with hand to renew the top of the insole. The flat bottom panel maybe added with far-infrared generating stone power to eliminate unpleasant smell.

DETAILED DESCRIPTION OF THE PREFERRED EMBODIMENT

Figure 1:
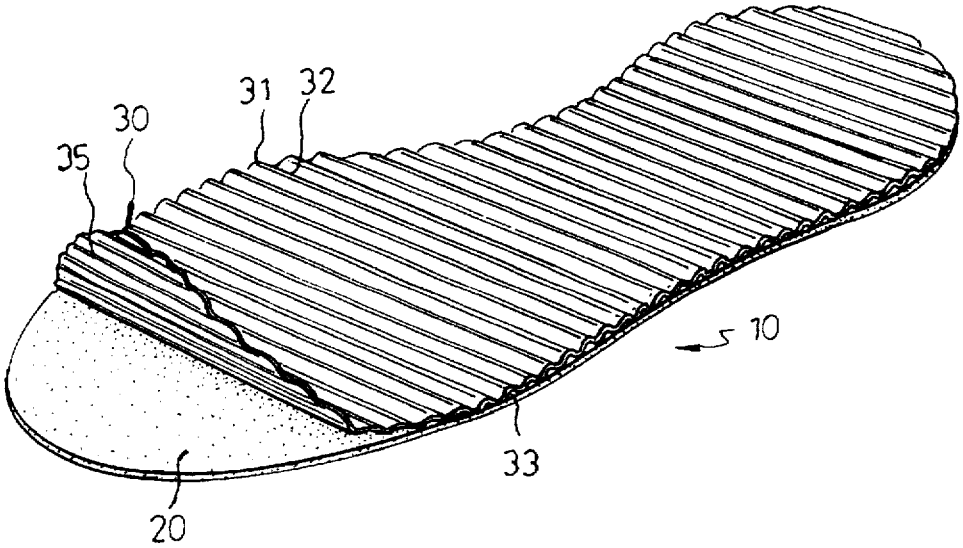
FIG. 1 shows the structure of a two-layer disposable insole according to the present invention.

Referring to FIG. 1, an insole 10 in accordance with the present invention is generally comprised of a flat base panel 20, and a corrugated cover panel 30 covered on the flat base panel 20. The corrugated cover panel 30 comprises folds 31 and furrows 32 alternatively arranged together. When the corrugated cover panel 30 is covered on the flat base panel 20, a plurality of ventilation spaces 33 are defined between the corrugated bottom wall 35 of the corrugated cover panel 30 and the top side of the flat base panel 20. The flat base panel 20 and the corrugated cover panel 30 are preferably made from paper material. The flat base panel 20 must be made from absorptive material so as to absorb damp or unpleasant smell.

Figure 2:
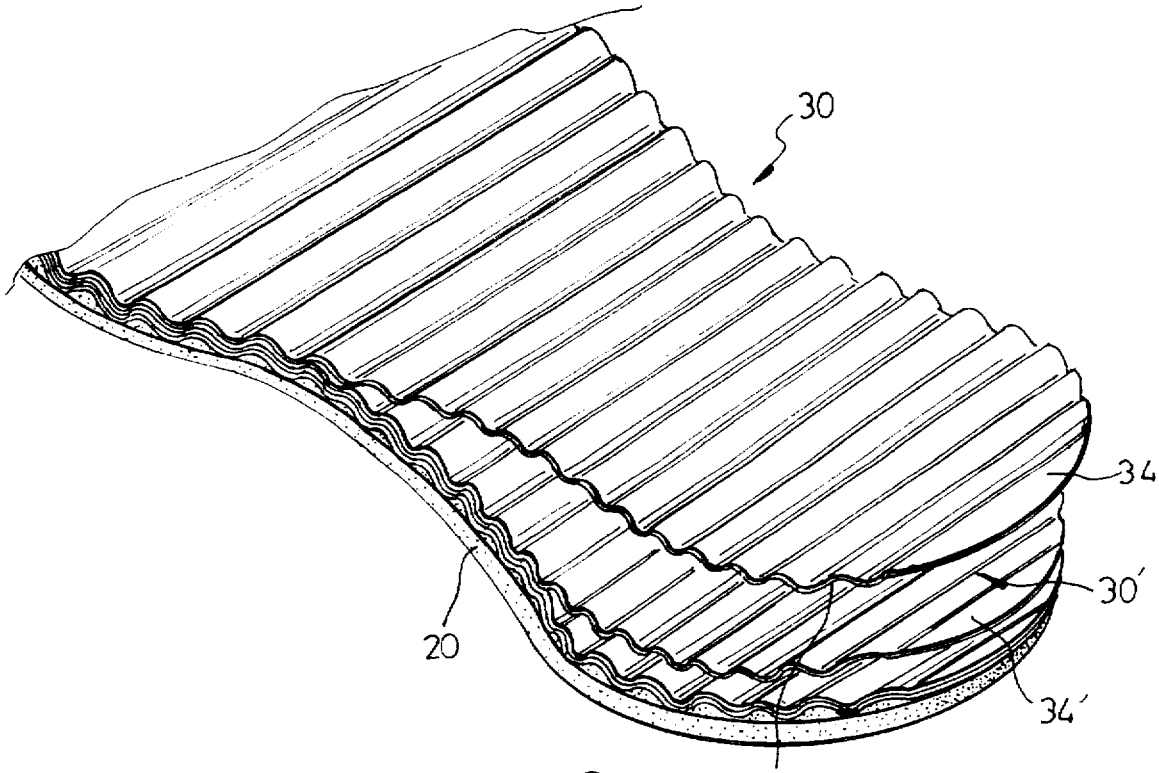
FIG. 2 shows the structure of a multi-layer disposable insole according to the present invention.

FIG. 2 shows an alternate form of the present invention. According to this alternate form, the insole comprises a flat base panel 20, a corrugated cover panel 30, and a plurality of corrugated intermediate panels 30' arranged between the bottom wall 35 of the corrugated cover panel 30 and the top side of the flat base panel 20. The corrugated cover panel 30 has a tongue 34 at the front end. Each of the corrugated intermediate panels 30' has a tongue 34' at the front end.

Figure 3:
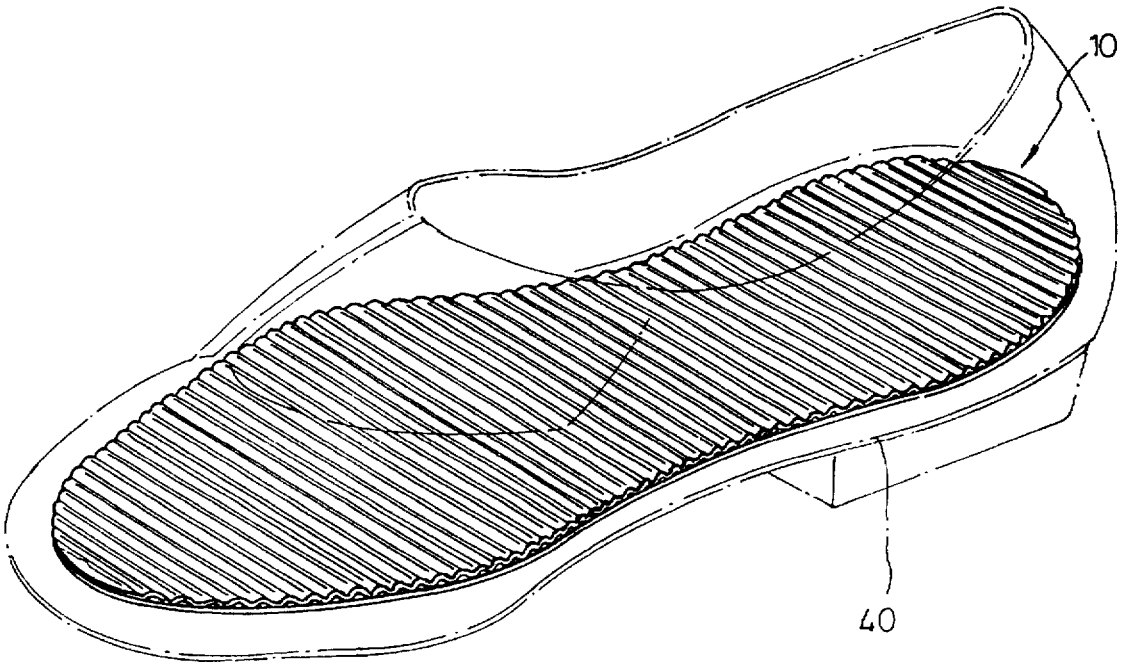
FIG. 3 is an applied view of the present invention, showing the insole put in a shoe.

Referring to FIG. 3 and FIG. 1 again, the insole 10 is adapted for putting in a shoe 40. When the insole 10 is put in a shoe 40, damp or unpleasant smell is allowed to pass through the ventilation spaces 33. When passing through the ventilation spaces 33, damp or unpleasant smell is absorbed by the flat base panel 20. When the user puts on the shoe 40, the folds 31 and furrows 32 of the corrugated cover panel 30 define with the sole of the user's foot spaces for ventilation.

Referring to FIG. 2 again, by holding the tongue 34 of the corrugated cover panel 30 with the hand, the corrugated cover panel 30 can be detached from the insole to renew the top of the insole or to reduce its thickness.

It is to be understood that the drawings are designed for purposes of illustration only, and are not intended as a definition of the limits and scope of the invention disclosed.

What the invention claimed is:

1. An insole comprising an absorptive flat paper base panel, and a plurality of stacked corrugated paper cover panels mounted on said absorptive flat paper base panel and defining with said absorptive flat paper base panel a plurality of ventilation spaces, each of said corrugated paper cover panels having a plurality of alternating folds and furrows and a tongue at one end, said stack of corrugated paper cover panels being detachably connected together such that uppermost corrugated paper cover panels can be successively removed from the insole, all corrugated paper cover panels in the stack having equal lateral dimensions.

2. The insole of claim 1 wherein said absorptive flat paper base panel has far-infrared generating stone power.

* * * * *